US006393671B1

(12) United States Patent
Chen

(10) Patent No.: US 6,393,671 B1
(45) Date of Patent: May 28, 2002

(54) ELASTIC BELT BUCKLE

(76) Inventor: Sin-Hsing Chen, No. 3, 73 Lane Chingshin St., Taipei Hsien (TW)

( * ) Notice: Subject to any disclaimer, the term of this patent is extended or adjusted under 35 U.S.C. 154(b) by 0 days.

(21) Appl. No.: 09/579,433

(22) Filed: May 26, 2000

(51) Int. Cl.[7] ..... A44B 1/04

(52) U.S. Cl. ..... 24/163 R; 24/180; 24/181; 2/322

(58) Field of Search ..... 24/163 R, 185, 24/180, 188, 181, 191, 194, 265 EC, 265 BC; 224/587; 2/300, 332, 322

(56) References Cited

U.S. PATENT DOCUMENTS 1,463,904 A * 8/1923 Mix ..... 24/180
1,618,389 A * 2/1927 Sampson et al. ..... 24/163 R
1,619,138 A * 3/1927 Kollstede ..... 24/180
1,622,954 A * 3/1927 Macheroux ..... 24/163 R
1,737,492 A * 11/1929 Carroll ..... 24/163 R
1,814,275 A * 7/1931 Wirth ..... 24/163 R
2,087,151 A * 7/1937 Hornberger ..... 24/188
2,203,270 A * 6/1940 O'Brien ..... 24/163 R
2,388,752 A * 11/1945 Loos, Jr. ..... 2/322 X
2,860,398 A * 11/1958 McPherson ..... 24/163 R
3,150,427 A * 9/1964 Rossi ..... 24/163 R
3,208,124 A * 9/1965 Rossi ..... 24/181

* cited by examiner

*Primary Examiner*—Robert J. Sandy
(74) *Attorney, Agent, or Firm*—Harrison & Egbert

(57) ABSTRACT

An elastic belt buckle, especially suitable for costumes and pants, having a prong which can slide on the buckle base by means of an elastic device. The buckle uses a structure that fastens the belt at a flexible position properly by inserting the prong into a punch hole to make one's waist more comfortable or even to prevent it being hurt when one bends forward, crouches, or dances.

3 Claims, 10 Drawing Sheets

ELASTIC BELT BUCKLE

BACKGROUND OF THE INVENTION

1. Field of the Invention

The present invention relates to an elastic belt buckle comprising a frame and a prong. The frame has a cover for the belt to penetrate, and the front end of the frame fastens the front end of the belt, and one end of the prong base is fixed on the frame while the prong can elastically slide along with the belt when setting the belt so that the prong is inserted in the punch hole to tighten the belt.

2. Description of the Related Art

As shown in FIG. 1, a conventional belt buckle uses two types of structures. If the wearer does not unbuckle the belt and insert the prong into the next punch hole, the buckle cannot adjust the length of the belt automatically; that is, they require steps.

A conventional belt buckle uses a structure that fastens the belt at one fixed position at a time, whether it uses a prong to insert into a punch hole or it uses a ratchet piece to hold the belt. So, when a person wears clothes of different materials or outfits of various kinds, or when he sits down, crouches, or takes a different pose, the belt may make him uncomfortable.

One of the ways to deal with the uncomfortable feeling is to take it easy or entirely ignore it; the other way is to adjust the position the buckle is secured on the belt. The conventional belt seldom uses an automatic positioning structure; that is, a person must unbuckle the belt many times to adjust the length to fit his waist. Sometimes, the belt cannot be adjusted properly for his waist and it looks ugly and loose. When he eats or drinks too much at a party, he may feel the belt too tight. As shown in FIG. 1, there are two types of conventional belt buckles. If a prong (20', 20") is not adjusted down to the next punch hole (42', 42") to loosen the belt, one's stomach may feel uncomfortable as if he is wearing clothes too small for him. If he wants to unfasten or adjust it, he has to leave the table and go to the toilet. What is more, according to a study on ergonomics, when one stands or walks, the camber and tension of one's waist change from 2 to 3 cm; when one crouches, the tension is from 2 to 3 kg; when one does exercises the tension of his waist is from 2 to 3 kg; when one suddenly takes a different pose, the increasing waist length is from 3 to 5 cm and the waist tension is from 3 to 5 kg. If the waist length and tension change so often, few people like to use the conventional belt buckle which can only be adjusted in length by inserting a prong into a punch hole each time for each step. That is the reason why a hard working porter or vendor often hurts his own waist.

BRIEF SUMMARY OF THE INVENTION

The present invention is an elastic belt buckle, especially suitable for costumes and pants, having a prong which can slide on a buckle base by means of an elastic device.

DETAILED DESCRIPTION OF THE INVENTION

Figure 2:
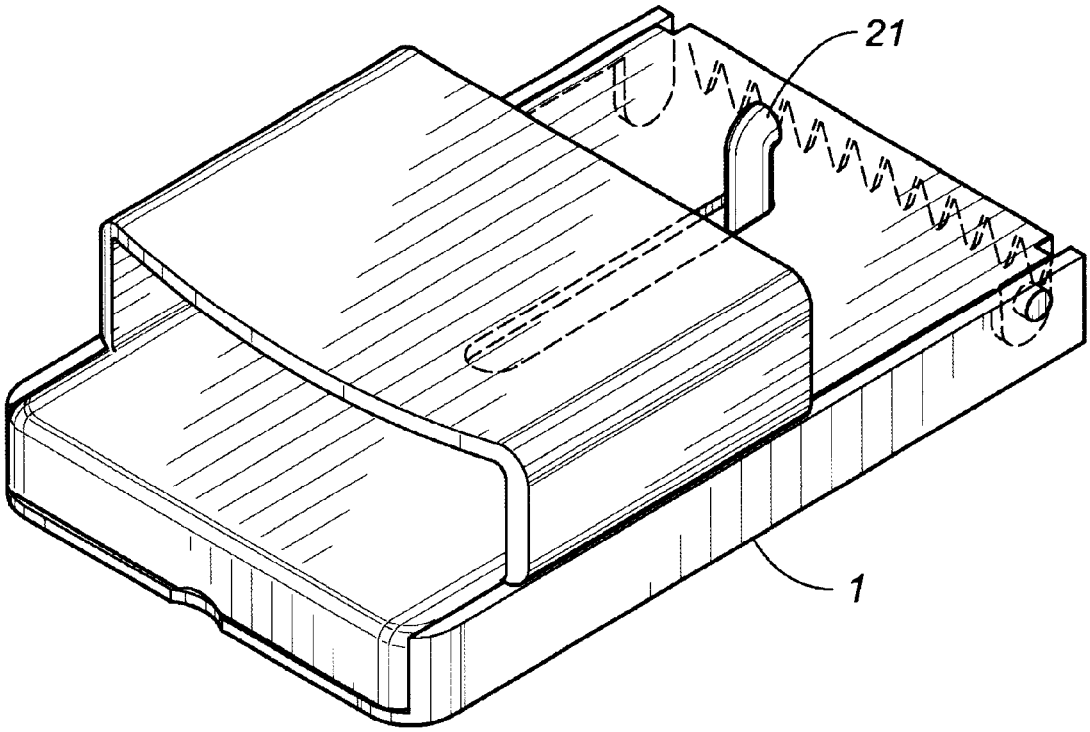
FIG. 2 is a perspective view for an embodiment of the invention.
Figure 3:
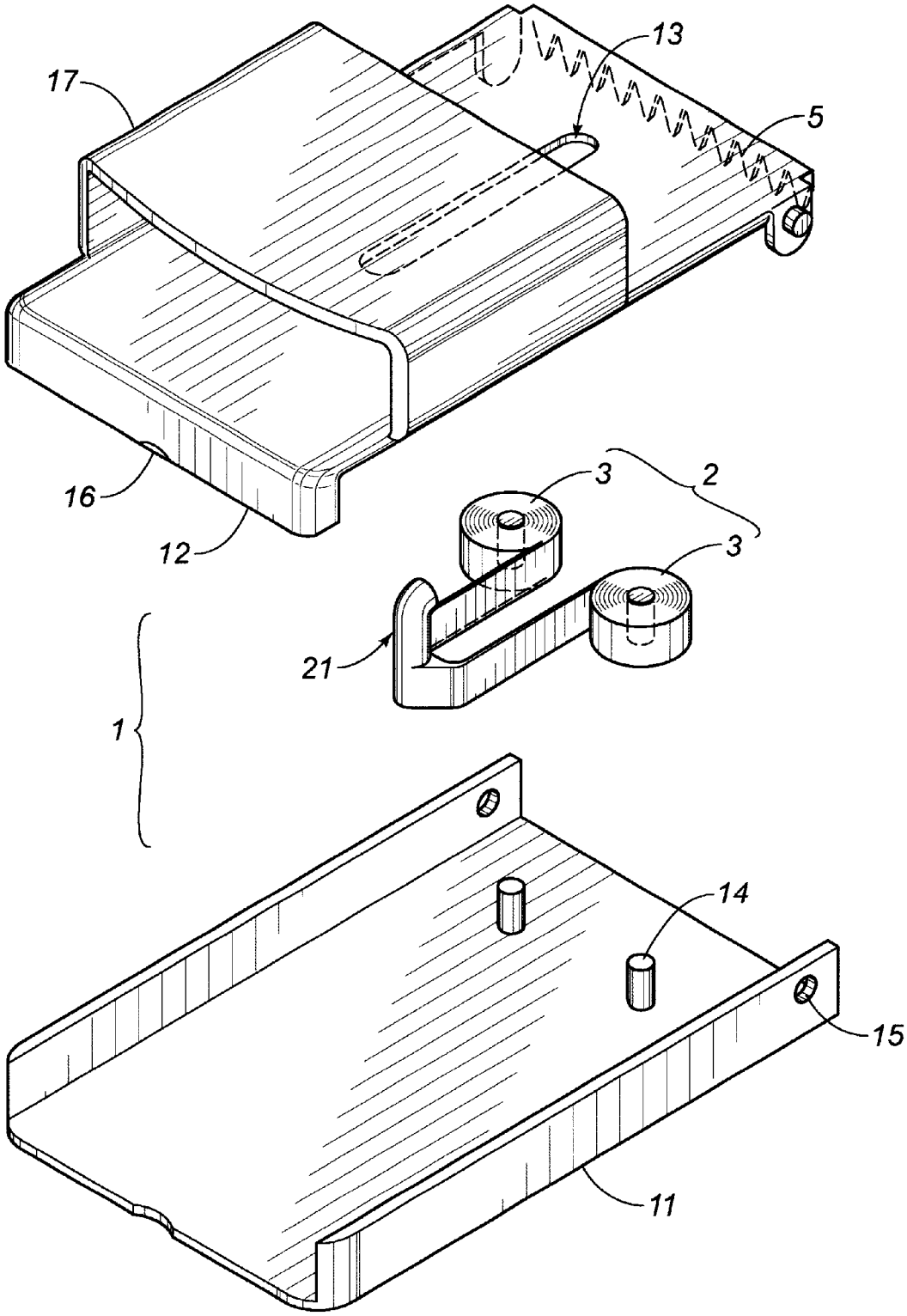
FIG. 3 is an analytical drawing for an embodiment of the invention.

As shown in FIG. 2, a perspective view for an embodiment of the invention, an elastic belt buckle uses a structure that is comprised of a frame base (1) and an elastic prong (2). The detailed parts of the structure of the invention are analytically illustration in FIG. 3. The frame base (1) is a frame body with a mouth-shaped sectional phase composed of a rim (12) and a buckle seat (11) with a U shaped sectional phase. One end of the frame body has a ratchet holder (5) to secure to the front end of the belt. There is disposed a shaft hole (15) for the rim (12) to pivot at one end of the buckle seat (11) with a U shaped sectional phase so as to form a switching frame base (1). The buckle seat (11) has a pin (14) to fix a spring. The rim (12) provides a cover (17) on its surface for the belt to penetrate. On the surface of the rim (12) there is a long hole (13) along with the rim (12) for the prong (21) to slide up and down. A tenon (16) is fixed at the other end of the rim (12) to match a sunken flange of the buckle seat (11). The prong (2) has a rounded head at its upper end. At the bottom end of the prong (2) there is a pivoted spring (3) which is a spiral power spring scroll. A scroll of the spring (3) is mounted on the pin (14) of the buckle seat (11). By means of the potential flexibility of the spring (3), the prong head (21) which extends itself above the rim (12) has a draw force to slide along with the long hole (13) on the buckle seat (11).

Figure 1:
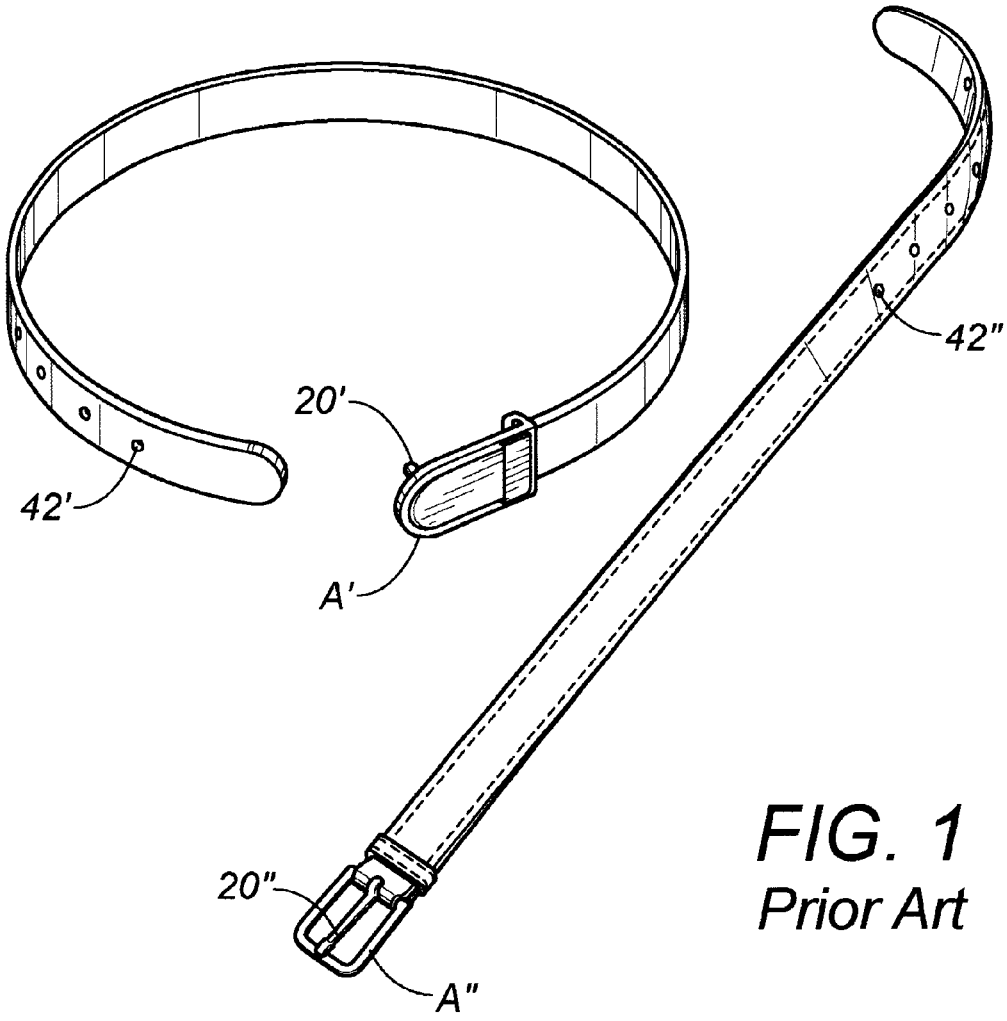
FIG. 1 Prior Art
FIG. 1 is a schematic view of a traditional belt buckle.
Figure 4:
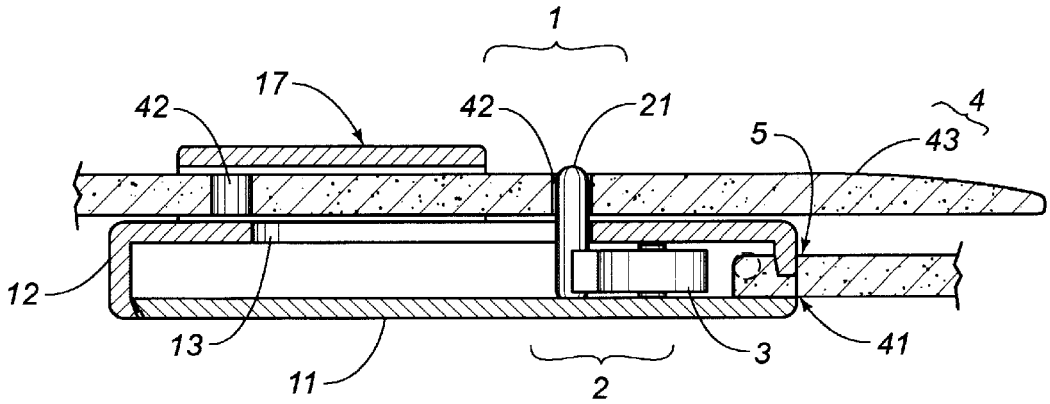
FIG. 4 is a schematic view for an operation of the invention.(I)
Figure 5:
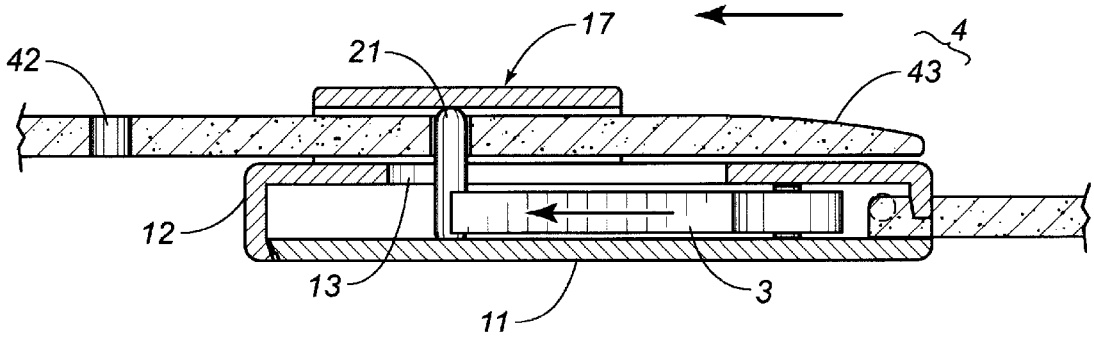
FIG. 5 is another schematic view for an operation of the invention.(II)

As shown in FIGS. 4 and 5, a schematic view of an operation of the invention, the way to use a traditional belt buckle (A,A')is the same as that of the invention (as shown in FIG. 1). The front end of the belt (41) is held by a ratchet holder (5) to the front end of the frame base (1). The back end of the belt (43) penetrates the cover (17) on the frame base (1) and then when the belt (4) is at its proper length, the prong head (21) extending itself above the long hole (13) on the rim (12) inserts into one of the punch holes (42), the belt (4) penetrates the cover (17) so the prong (2) will not get away from the buckle (11).

The elastic belt buckle has a slide prong (2) which can extend itself according to the tension from the changing diameter of a person's waist. Thus, it can make him feel more comfortable when he bends forward, crouches, or suddenly takes a different pose.

Figure 6:
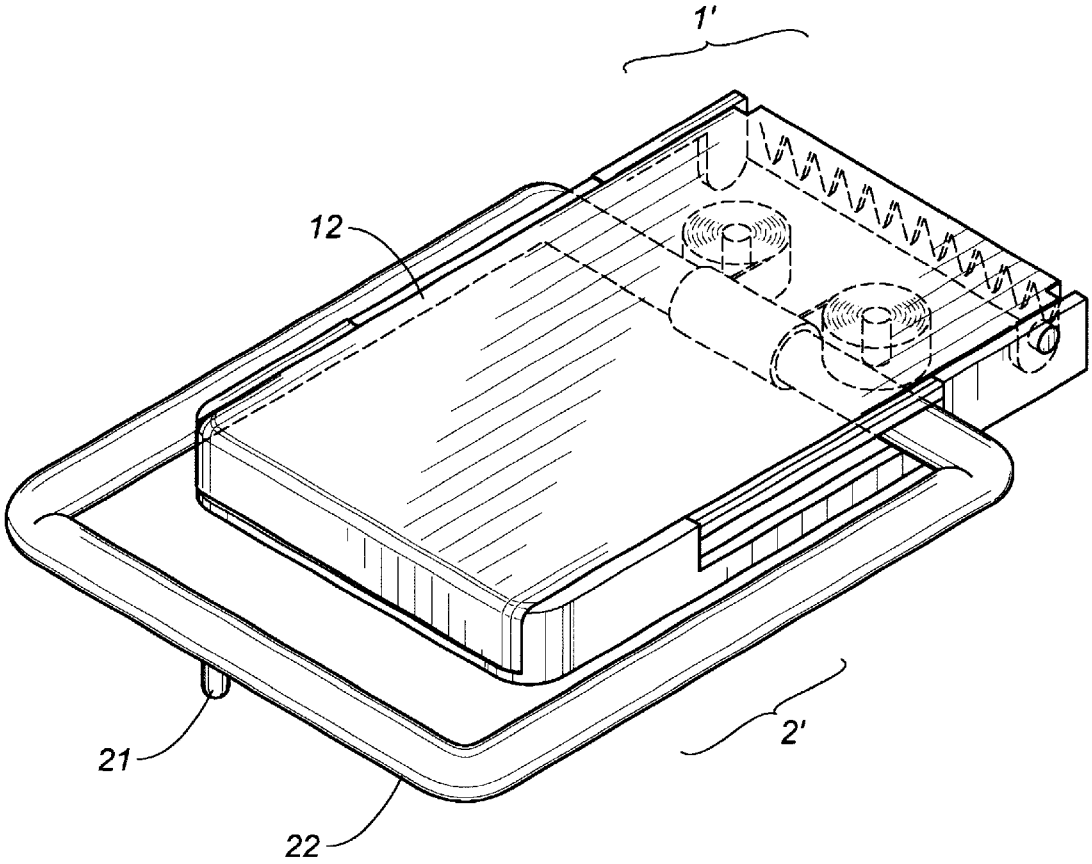
FIG. 6 is another drawing for an embodiment of the invention.(I)

As shown in FIG. 6, the frame base (1') can also use a structure which eliminates the cover (17) on the rim (12'), provides a long hole (13') at the side of the rim (12') for a ring (22) to slide along the rim (12'), and extends a prong (21') from the lower bottom of the rim (12). This structure provides a variation in the exterior of the invention.

Figure 7:
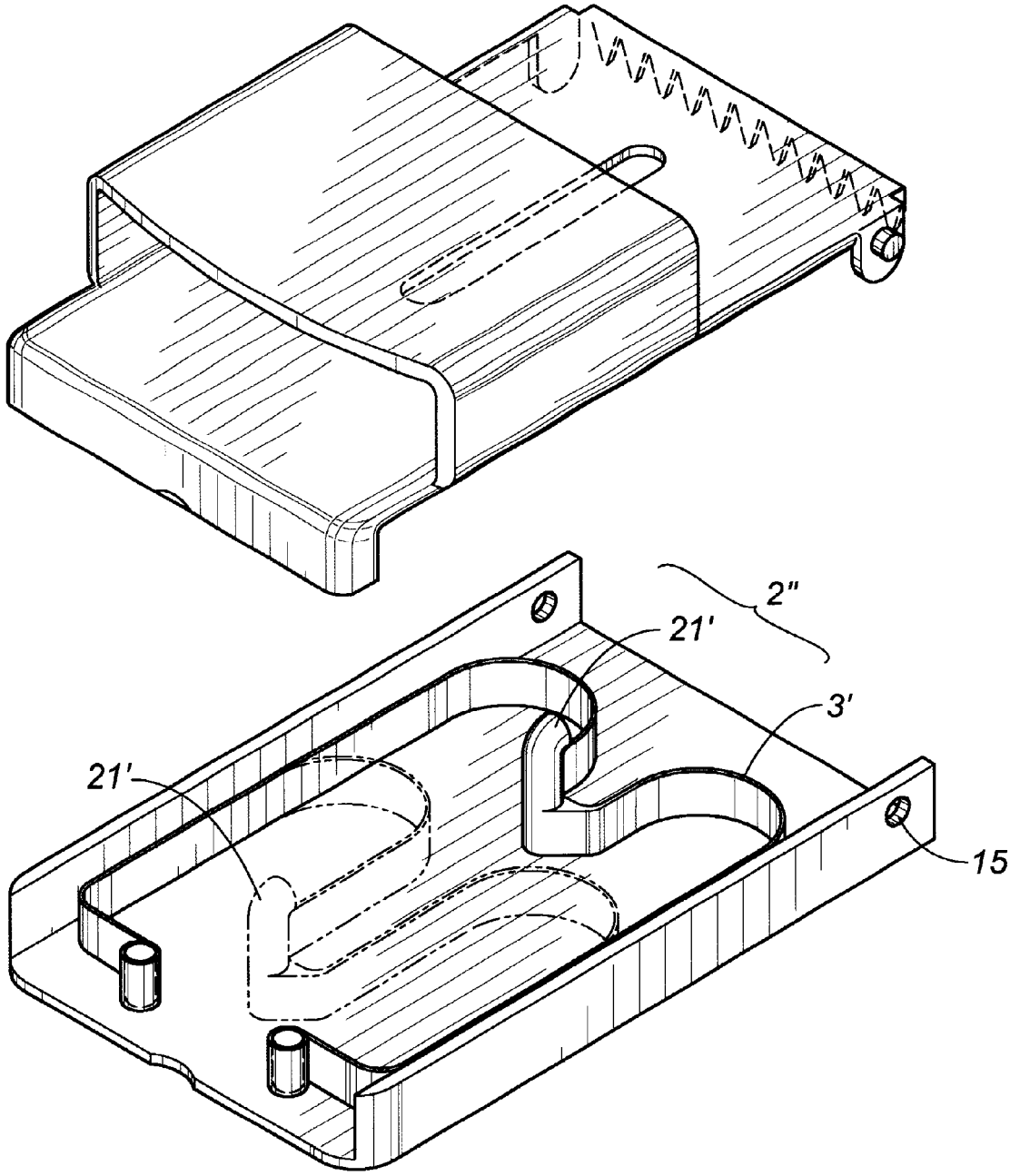
FIG. 7 is another drawing for an embodiment of the invention (II)

As shown in FIG. 7, a spring (3) which provides a draw force for the prong (2") to slide and extend when it receives a proper tension can be replaced by a bending plate spring.

Figure 8:
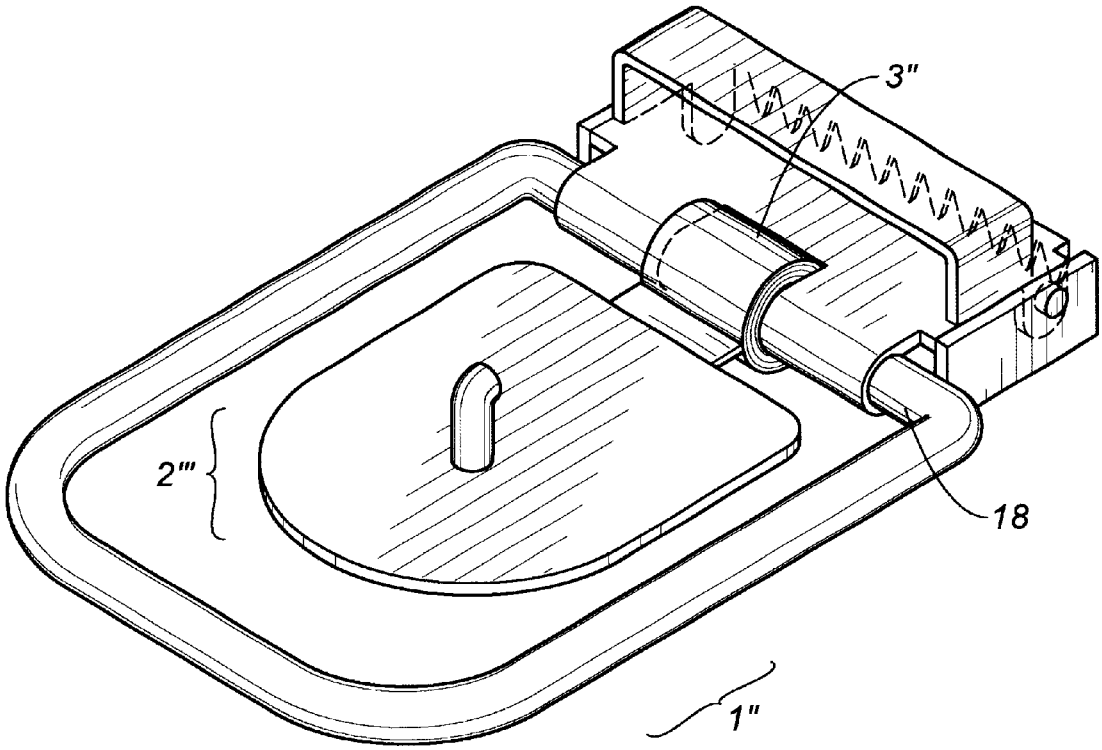
FIGS. 8, 9, 10 are other drawings for other examples of the invention.

As shown in FIG. 8, the frame base can be injection molded to be a ring (1"). One end of the ring (1") is a shaft (18) which provides a fixing device for a spiral power spring (3") so as to obtain flexibility and extending force from the prong (2'").

Figure 9:
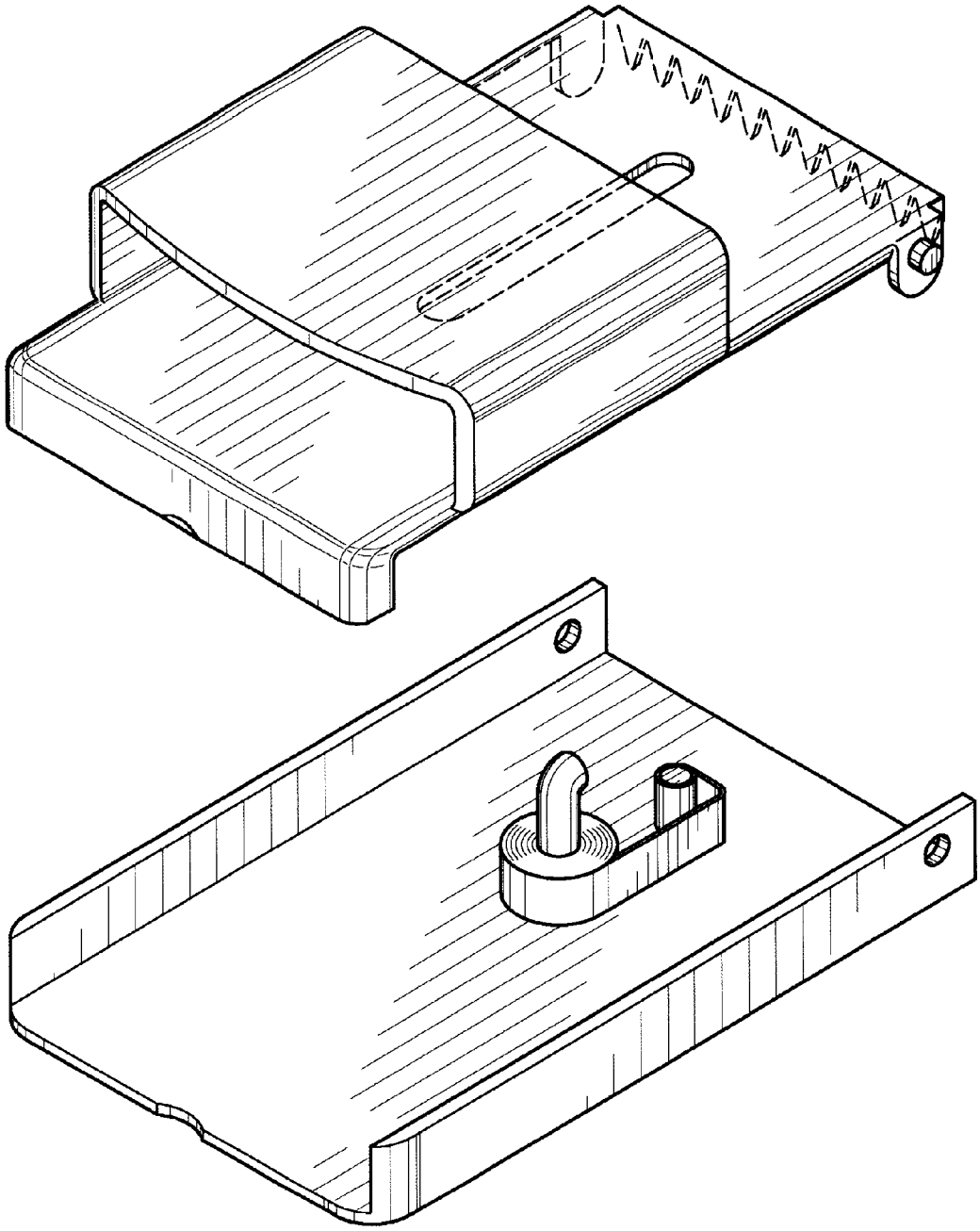

As shown in FIG. 9, the spring can use a single spiral power scroll, and the prong is disposed at the center of the spring and one end of the spring is fixed on the frame base.

Figure 10:
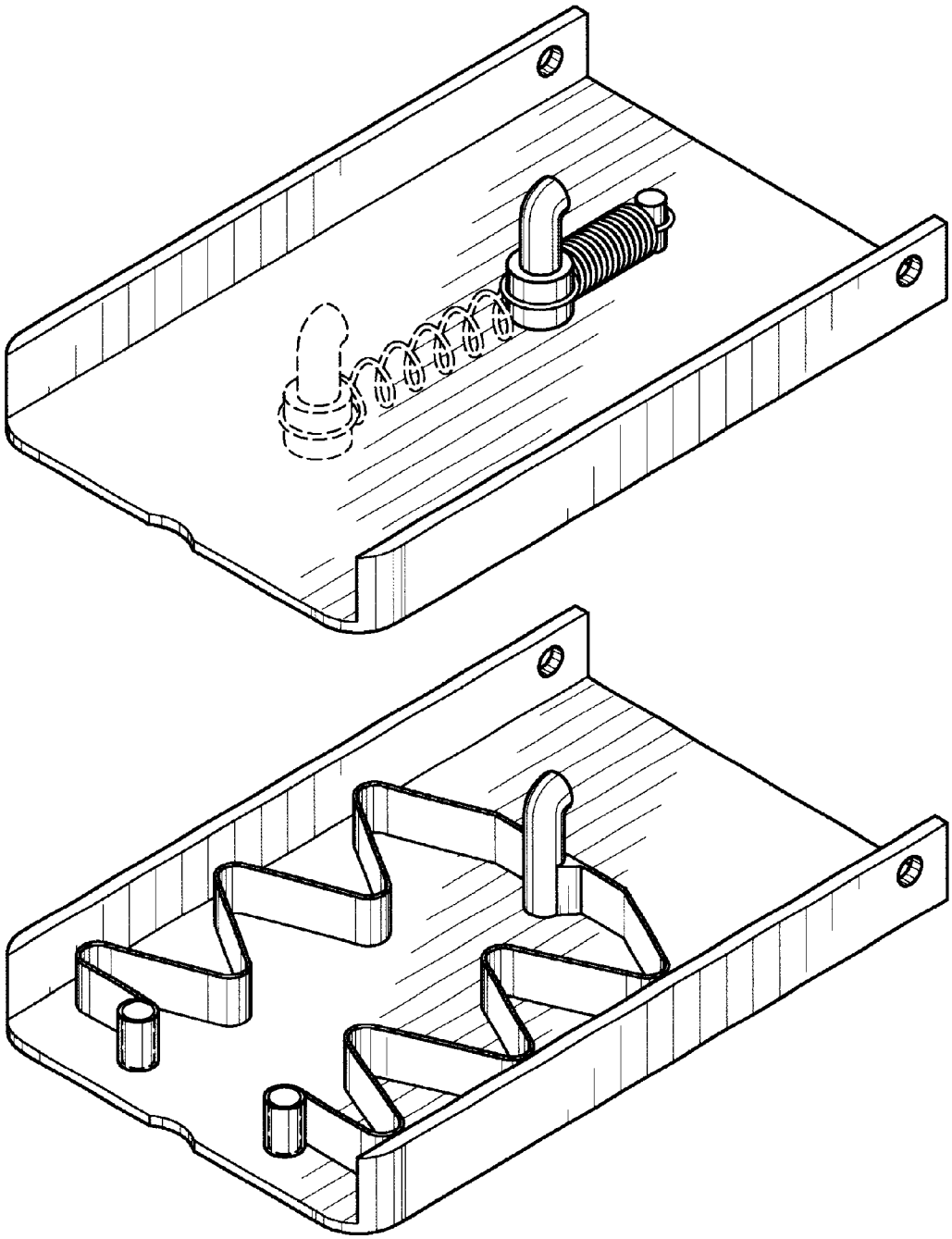

As shown in FIG. 10, the spring for the prong can also be a general screw drawing type or ratchet bending plate type.

Figure 11:
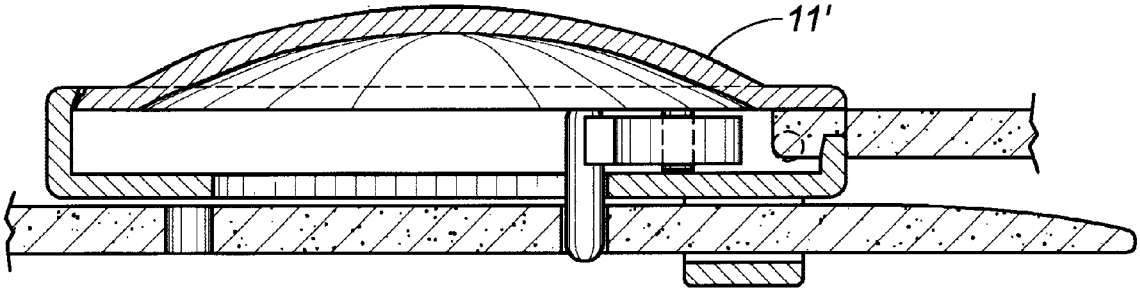
FIG. 11 is a view for an application of the invention.

As shown in FIG. 11, the invention can use a structure which turns its original one all over; that is, the frame base (11') is turned to be on the outside so as to provide a bigger room for exterior designing.

What is claimed is:

1. An elastic belt buckle device comprising:

a buckle frame base;

a prong fastened to one end of said buckle frame base;

a belt having a punch hole formed therein; and a cover connected to said buckle frame base, said belt having a portion extendable through said cover, said prong insertable into said punch hole of said belt, said prong slidable along with said belt when a pulling force is applied to an end of said belt, said buckle frame base comprising:

a ring-shaped frame having a shaft at one end; and a power spring scroll fixed to said shaft, said prong connected to said ring-shaped frame.

2. An elastic belt buckle device comprising:

a buckle frame base;

a prong fastened to one end of said buckle frame base;

a belt having a punch hole formed therein;

a spring connected to said prong, said spring having a bending plate spring; and a cover connected to said buckle frame base, said belt having a portion extendable through said cover, said prong insertable into said punch hole of said belt, said spring causing said spring to be slidable along with said belt when a pulling force is applied to an end of said belt.

3. An elastic belt buckle device comprising:

a buckle frame base;

a prong fastened to one end of said buckle frame base;

a belt having a punch hole formed therein;

a spring connected to said prong, said spring being a ratchet bending spring plate;

a cover connected to said buckle frame base, said belt having a portion extendable through said cover, said prong insertable into said punch hole of said belt, said prong slidable along with said belt when a pulling force is applied to an end of said belt.

* * * * *